US008132295B1

(12) United States Patent
Otis et al.

(10) Patent No.: US 8,132,295 B1
(45) Date of Patent: Mar. 13, 2012

(54) INTERCHANGEABLE CUSTOMIZABLE PULL MECHANISMS

(75) Inventors: Kelly Renee Otis, Woodland, WA (US); Mike Burnham, Gresham, OR (US)

(73) Assignee: Kreations, LLC, Woodland, WA (US)

( * ) Notice: Subject to any disclaimer, the term of this patent is extended or adjusted under 35 U.S.C. 154(b) by 382 days.

(21) Appl. No.: 12/397,345

(22) Filed: Mar. 3, 2009

Related U.S. Application Data

(60) Provisional application No. 61/033,092, filed on Mar. 3, 2008.

(51) Int. Cl.
*A45C 3/00* (2006.01)

(52) U.S. Cl. ..... 16/412; 16/415; 40/325; 40/331

(58) Field of Classification Search ..... 16/412–414, 16/422, 417, 441, 433, DIG. 30, 415; 40/325, 40/331–332, 651, 490, 606.08, 611.06; 74/553; 312/348.6

See application file for complete search history.

(56) References Cited

U.S. PATENT DOCUMENTS

| | | | | | |
|---|---|---|---|---|---|
| 1,402,877 | A | * | 1/1922 | McKee et al. | 40/651 |
| 1,526,500 | A | | 2/1925 | Kasch | |
| 2,171,361 | A | | 8/1939 | Gits et al. | |
| 2,271,266 | A | | 1/1942 | Kost | |
| 2,351,260 | A | * | 6/1944 | Hall | 40/325 |
| 2,659,991 | A | * | 11/1953 | Strayer | 40/651 |
| 3,024,555 | A | | 3/1962 | Abeles | |
| 3,371,373 | A | | 3/1968 | Adams | |
| 4,604,786 | A | | 8/1986 | Howie, Jr. | |
| 4,608,882 | A | | 9/1986 | Howie, Jr. | |
| 4,766,642 | A | | 8/1988 | Gaffney et al. | |
| 4,862,642 | A | | 9/1989 | Alessi | |
| 5,144,718 | A | | 9/1992 | Ozawa | |
| 5,519,972 | A | | 5/1996 | Howie, Jr. | |
| 6,463,630 | B1 | | 10/2002 | Howie, Jr. | |
| 6,834,430 | B2 | | 12/2004 | Worrell | |
| 6,842,946 | B2 | | 1/2005 | Hayden | |
| 6,948,272 | B1 | | 9/2005 | Olivier et al. | |
| D517,898 | S | | 3/2006 | Veltz et al. | |
| 7,111,365 | B1 | | 9/2006 | Howie, Jr. | |
| 7,159,909 | B1 | | 1/2007 | Hung | |
| 7,246,413 | B2 | | 7/2007 | Portelli | |
| D563,193 | S | | 3/2008 | Lowe | |
| D568,714 | S | | 5/2008 | Bickler et al. | |
| D570,183 | S | | 6/2008 | Hanes | |
| D570,186 | S | | 6/2008 | Hanes | |
| 7,380,309 | B2 | | 6/2008 | Forsythe | |
| D579,749 | S | | 11/2008 | Jou | |
| D580,733 | S | | 11/2008 | Hanes | |
| 2002/0138949 | A1 | | 10/2002 | Hayden | |
| 2007/0069090 | A1 | | 3/2007 | Driscoll | |

* cited by examiner

*Primary Examiner* — William L. Miller
(74) *Attorney, Agent, or Firm* — Law Office of Karen Dana Oster, LLC

(57) ABSTRACT

A pull mechanism that is attachable to a barrier structure having a sliding mounting panel and at least one base. The sliding mounting panel having a first sliding-retaining member and the at least one base have a second sliding-retaining member. The sliding mounting panel is in sliding-retaining relationship with the base such that there is longitudinal movement therebetween. A fastener may be used to both fasten the pull mechanism to the barrier structure and to limit the sliding relationship, between the sliding mounting panel and the at least one base. In some preferred embodiments of the present invention the sliding mounting panel has a top surface to which decorative elements may be attached.

16 Claims, 8 Drawing Sheets

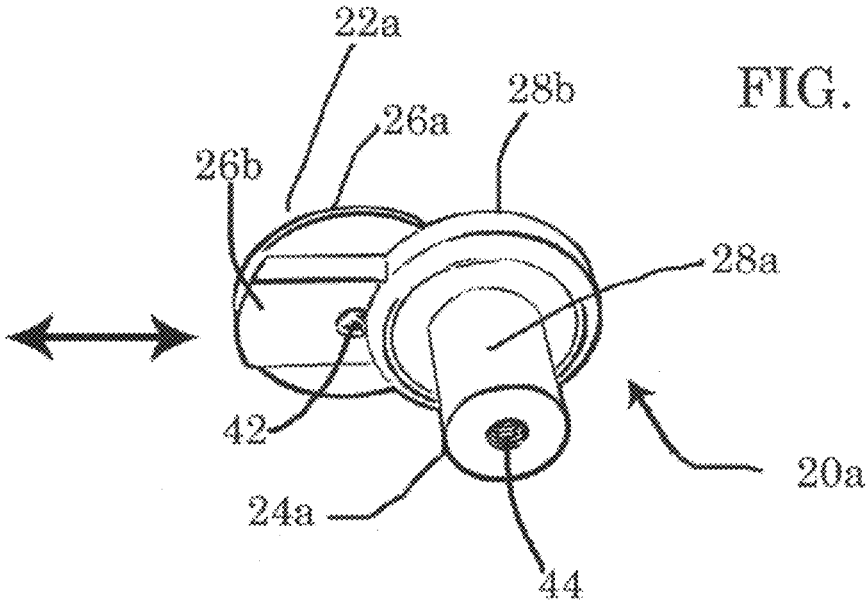
FIG. 1
FIG. 2
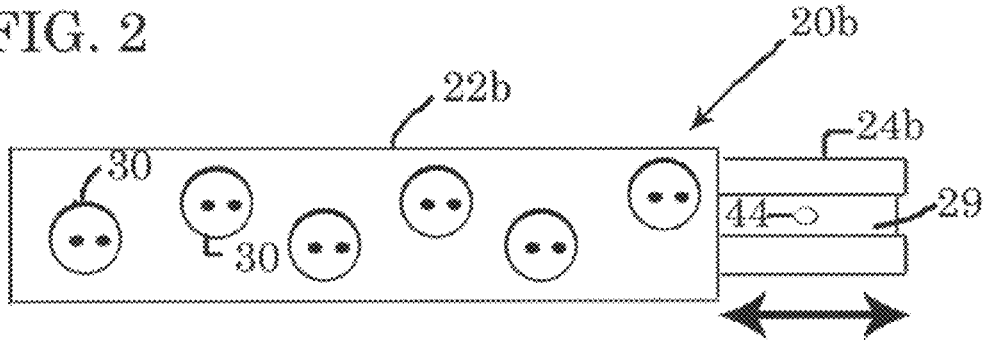
FIG. 3
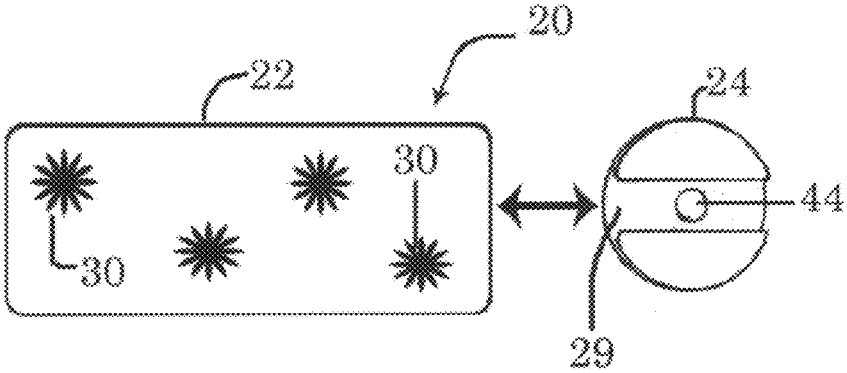

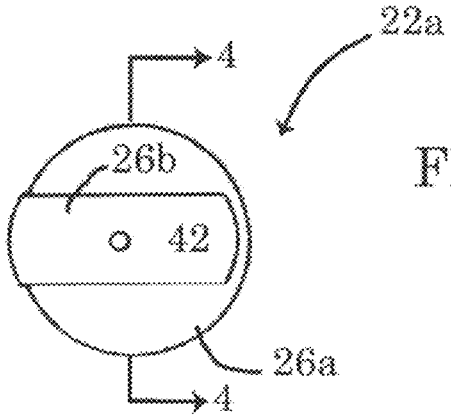
FIG. 4
FIG. 5
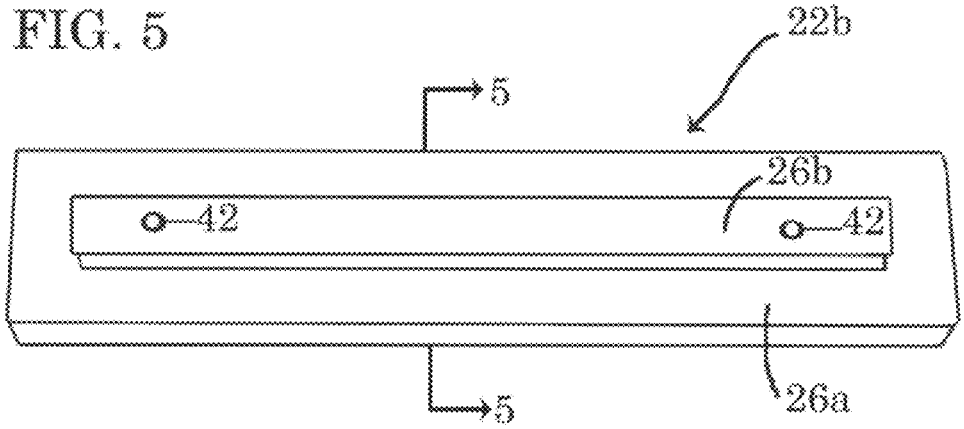
FIG. 6
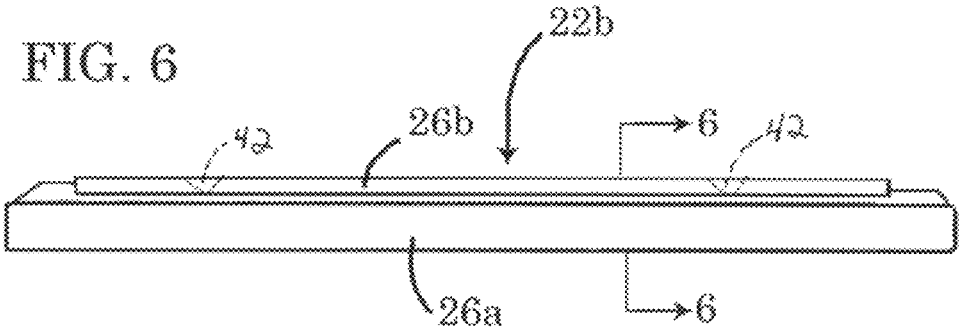

FIG. 16
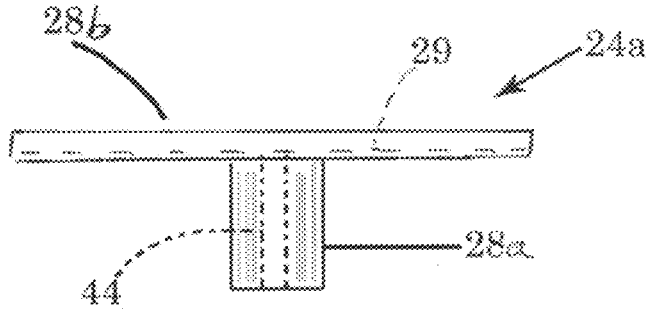
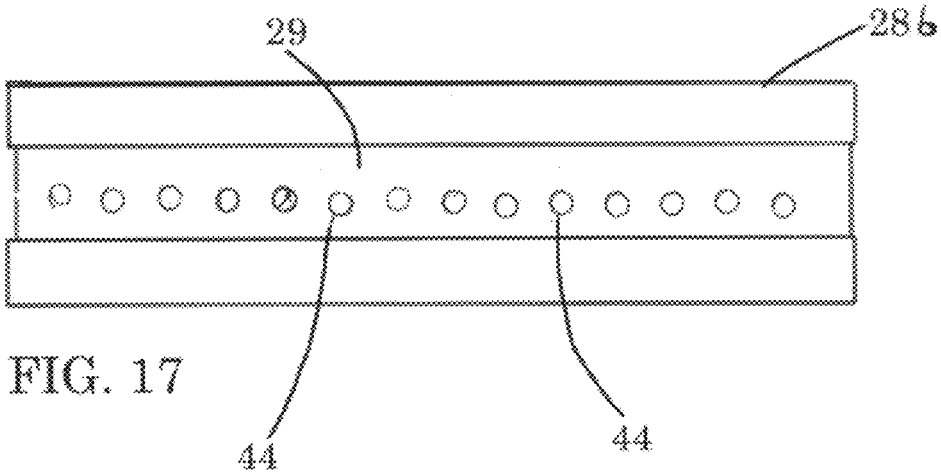
FIG. 17
FIG. 18
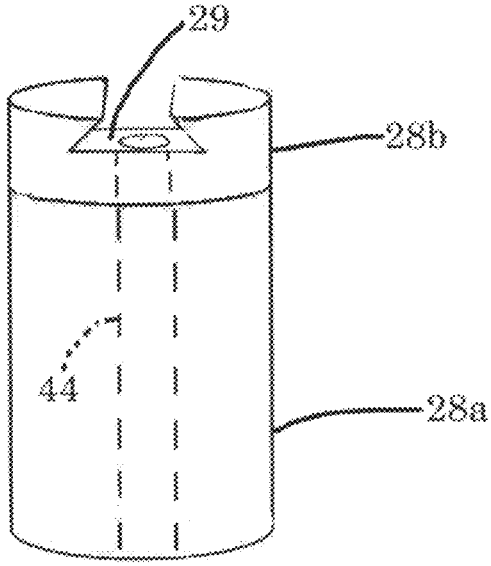

FIG. 19
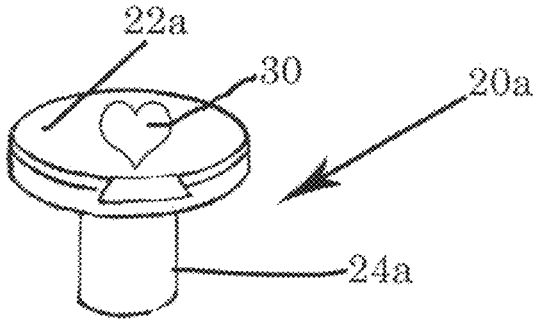
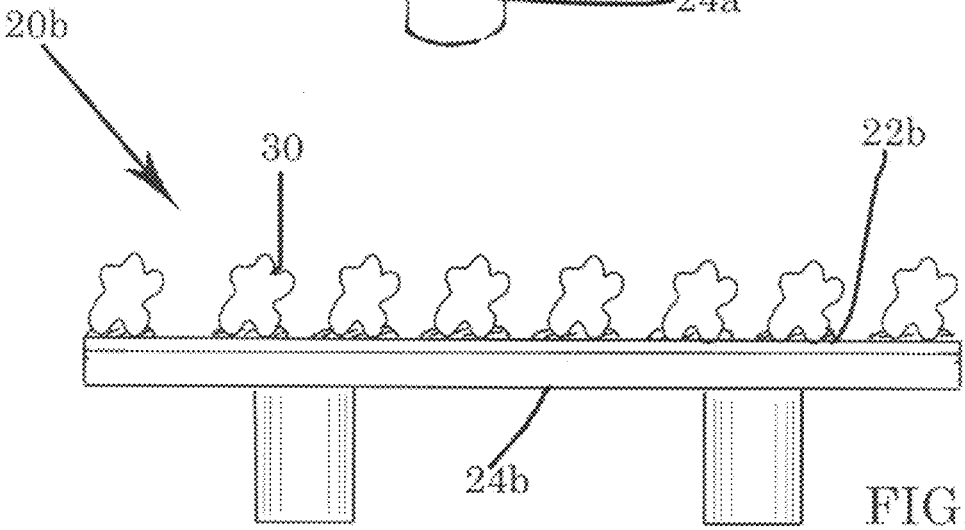
FIG. 20
FIG. 21
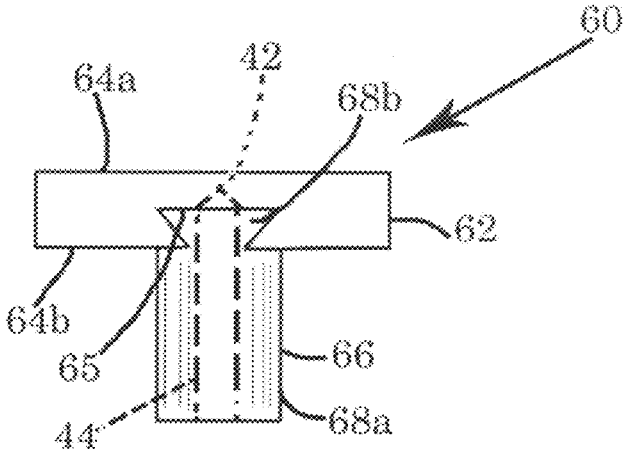

FIG. 22
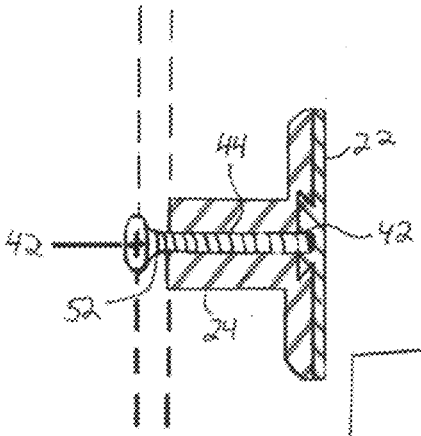
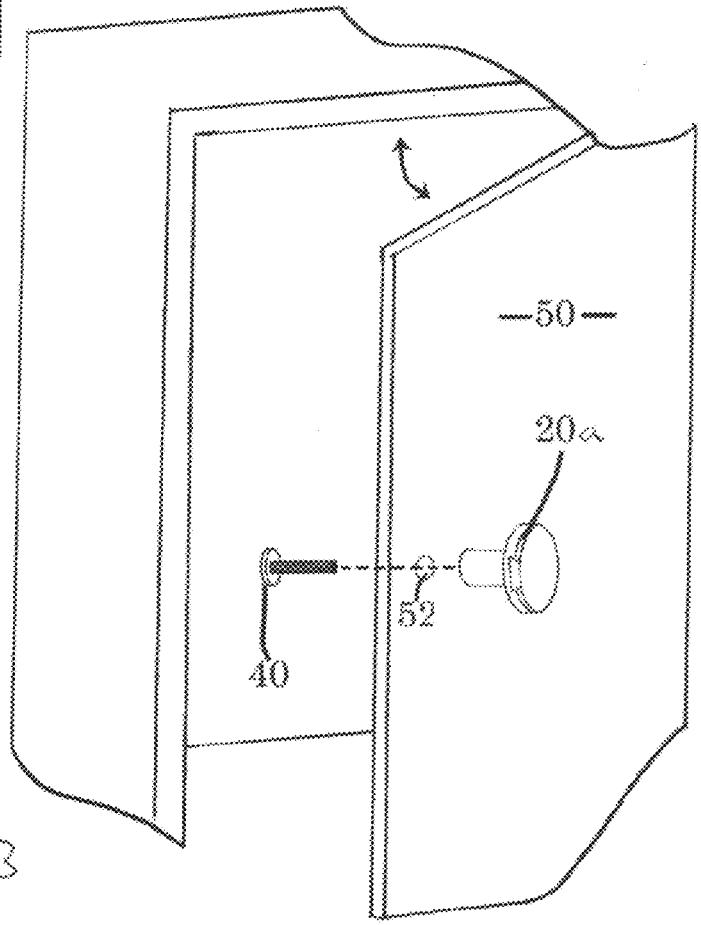
FIG. 23

INTERCHANGEABLE CUSTOMIZABLE PULL MECHANISMS

The present application is an application claiming the benefit under 35 USC Section 119(e) of U.S. Provisional Patent Application Ser. No. 61/033,092, filed Mar. 3, 2008. The present application is based on and claims priority from this application, the disclosure of which is hereby expressly incorporated herein by reference in its entirety.

BACKGROUND OF INVENTION

The present invention is directed to interchangeable and customizable pull mechanisms (e.g. knobs and handles) used on barrier structures.

Barrier structures are everywhere. Most doors are swinging barrier structures. Some doors, such as sliding glass doors and sliding closet doors are sliding barrier structures. Sometimes the barrier structures are just a face of another structure. For example, the face of a drawer barrier structure that slides because the drawer to which it is attached slides. Barrier structures can have other types of movement such as rotation. Some barrier structures (e.g. walls) are not movable.

To facilitate the actuation of the movement of a barrier structure, most barrier structures include a gripping mechanism such as a knob or a handle (herein after referred to generally as a "pull mechanism"). A pull mechanism is fastened to a barrier structure to provide a means for a user to move the barrier structure via the movement of the pull mechanism. For purposes of this specification, the term "knob" will be used to describe a pull mechanism that has a single point of contact with the barrier structure and the term "handle" will be used to describe a pull mechanism that has multiple points of contact with the barrier structure.

It should be noted that a pull mechanism may be used even if it does not facilitate movement. For example, a pull mechanism may be used on an unmovable barrier structure. The use of such a pull mechanism may be decorative or may serve another function (e.g. for use as a hook for hanging objects).

The proliferation of barrier structures generally tends to result in a proliferation of pull mechanisms. Cabinets, doors, furniture, and other fixtures often have pull mechanisms that are commonly used or purchased through commercial outlets. The manufacturer of these' fixtures may choose among a wide variety of commercially produced pull mechanisms. These pull mechanisms can affect the appearance, style, and feel of the fixtures and the spaces in which the fixtures occupy. For example, a typical kitchen might have twenty or more cabinet doors and drawers (barrier structures), each with its own pull mechanism. A typical bedroom set might have ten or more drawers in his and her dressers and night stands, each drawer with its own pull mechanism. It has long been known in remodeling circles that changing the pull mechanisms in a kitchen or on furniture can give the kitchen or furniture a quick "face lift." Home supply and hardware stores stock hundreds of variations of pull mechanisms. So users who don't like traditional pull mechanisms replace them with modern pull mechanisms, users who don't like whimsical pull mechanisms replace them with serious pull mechanisms, and/or users who don't like small and dainty pull mechanisms replace them with large and bulky pull mechanisms.

U.S. Pat. No. 7,111,365 to Howie, Jr. is directed to a knob with a decorative ring and snap-on cap. U.S. Pat. No. 6,463,630 to Howie, Jr. is directed to a knob with a decorative cover. U.S. Pat. No. 6,842,946 to Hayden is directed to a cabinet knob with an interchangeable fascia that uses magnetic means for securing the fascia to the knob. All of these devices theoretically would allow a user to change the look of the device by changing components.

BRIEF SUMMARY OF THE INVENTION

The present invention is directed to a pull mechanism that is attachable to a barrier structure. Preferred embodiments of the invention include a sliding mounting panel and at least one base. Preferred embodiments of the sliding mounting panel have a first sliding-retaining member. Preferred embodiments of the at least one base have a second sliding-retaining member.

In preferred embodiments the sliding mounting panel is in sliding-retaining relationship with the base such that there is longitudinal movement therebetween. In some preferred embodiments the first sliding-retaining member engages the second sliding-retaining member. In some preferred embodiments the sliding mounting panel and the base cannot be separated by forces perpendicular to the axis of longitudinal movement.

Some preferred embodiments of the present invention include a fastener that both for fastens the pull mechanism to the barrier structure and limits the sliding relationship between the sliding mounting, panel and the at least one base. In some preferred embodiments this is accomplished by the fastener passing through a bore in the barrier structure, through a bore passage of the at least one base, and into a bore stop of the sliding mounting panel.

In some preferred embodiments of the present invention the sliding mounting panel has a top surface to which decorative elements may be attached.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings, which are incorporated in and constitute a part of this specification, illustrate various exemplary embodiments.

FIG. 1 is a bottom perspective view of a knob pull mechanism with a knob sliding mounting panel in sliding-retaining relationship with a knob base.

FIG. 2 is a top plan view of a handle pull mechanism with a handle sliding mounting panel in sliding-retaining relationship with a handle base, the handle sliding mounting panel having decorative elements thereon.

FIG. 3 is a top plan view of a pull mechanism with a sliding mounting panel showing only one base, although multiple bases could be used, the sliding mounting panel having decorative elements thereon.

FIG. 4 is a bottom perspective view of a knob sliding mounting panel.

FIG. 5 is a bottom perspective view of a handle sliding mounting panel.

FIG. 6 is a side perspective view of a handle sliding mounting panel.

FIG. 16 is a side view of an alternative knob base that has an elongated rectangular sliding undercut groove component.

FIG. 17 is a top view of an alternative sliding undercut groove component having multiple bore passages through which a fastener may be inserted.

FIG. 18 is a perspective side view of an embodiment of a knob base in which the support component and the sliding undercut groove component have substantially identical circumferences or are a single integral unit.

FIG. 19 is a perspective side view of a knob pull mechanism with a knob sliding mounting panel in its closed relationship with a knob base, the knob sliding mounting panel having a decorative element thereon.

FIG. 20 is a side view of a handle pull mechanism with a handle sliding mounting panel in its closed relationship with a handle base, the handle sliding mounting panel having decorative elements thereon.

FIG. 21 is a side view of an alternative knob pull mechanism in its closed position or a latitudinal side view of an alternative handle pull mechanism in its closed position, this alternative embodiment having a sliding mounting panel with a mounting component and undercut groove component (with an undercut groove therein) and a base with a support component and a sliding protrusion component.

FIG. 22 is a cross-sectional side view of a knob or a cross-sectional latitudinal side view of a handle, the knob or handle being fastened to a barrier structure (shown in phantom).

FIG. 23 is an expanded perspective view of a knob being fastened to a swinging barrier structure.

DETAILED DESCRIPTION OF THE INVENTION

Figure 7:
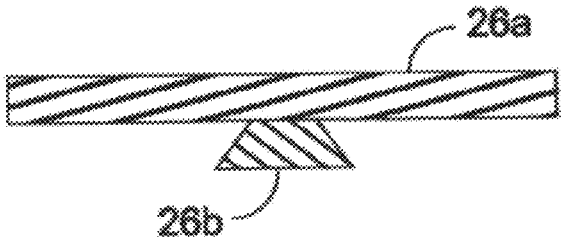
FIGS. 7-10 are cross-sectional side views of exemplary embodiments of the sliding mounting panels taken along lines 4-4, 5-5, or 6-6.

The present invention is directed to interchangeable and customizable pull mechanisms 20 (shown as knobs 20*a* and handles 20*b*), and more specifically to pull mechanisms 20 in which a removable sliding mounting panel 22 (shown as knob sliding mounting panels 22*a* and handle sliding mounting panels 22*b*) is in a "sliding-retaining" relationship with at least one base 24 (shown as knob bases 24*a* and handle bases 24*b*). Decorative elements 30 (which may be, for example, decorative, informational, or created elements) may be attached to the mounting panels 22. In preferred embodiments of the present invention, a fastener 40 may be used both to secure the base 24 to a barrier structure 50 and to secure the sliding mounting panel 22 to the base(s) 24.

Preferred embodiments of the present invention allow users extreme flexibility in customizability so that they can create pull mechanisms 20 that best fit their style or need of today, and in interchangeability so that they can change to pull mechanisms 20 that best fit their, style or need of tomorrow. This may be done, for example, based on the season of the year, for special occasions (e.g. birthdays and holidays), to fit a theme (e.g. nautical or macabre), based on the use of the fixture (e.g. a maturing child may not want baby-themed pull mechanisms), or to accommodate the user's creativity.

Please note that the terms and phrases, where otherwise not specifically defined, are given their ordinary meaning. Exemplary embodiments may be better understood with reference to the drawings, but these embodiments are not intended to be of a limiting nature. For example, shapes and dimensions are meant to be exemplary and are not meant to limit the scope of the invention. The same reference numbers will be used throughout the drawings and description in this document to refer to the same or like parts.

Removable Sliding Mounting Panels and Bases

The removable sliding mounting panels 22 (shown as knob sliding mounting panels 22*a* and handle sliding mounting panels 22*b*) and bases 24 (shown as knob bases 24*a* and handle bases 24*b*) are in a sliding-retaining relationship to each other. As set forth above, for purposes of this specification, the term "knob" will be used to describe a pull mechanism that has a single point of contact with the barrier structure 50, and the term "handle" will be used to describe a pull mechanism that has multiple points of contact with the barrier structure 50. Accordingly, FIG. 1 shows a knob sliding mounting panel 22*a* and a knob base 24*a*, FIG. 2 shows a handle sliding mounting panel 22*b* and a handle base 24*b* (as part has already been slid under the mounting panel 22*b*), and FIG. 3 could be either type (knob or handle), depending on how many bases 24 are used.

Figure 8:
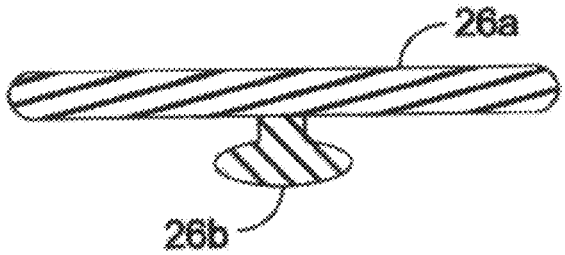
Figure 9:
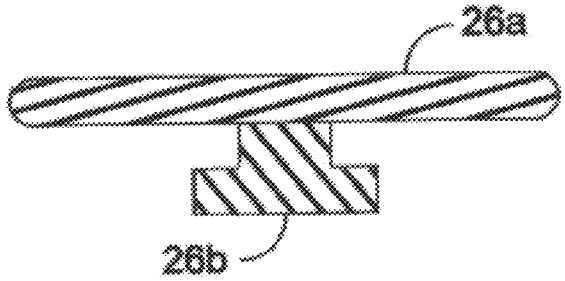
Figure 10:
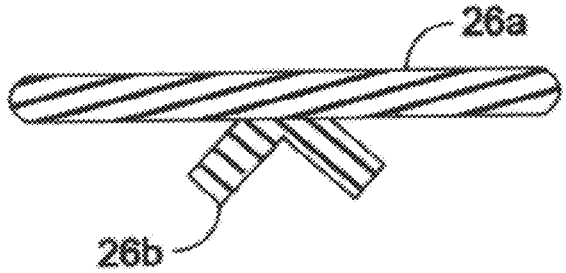

Each sliding mounting panel 22 is constructed of two components, a mounting component 26*a* and a sliding protrusion component 26*b* (which can be thought of the first sliding-retaining member). It should be noted that the components may be constructed separately (multiple pieces attached together) and/or integrally. FIG. 4 shows a bottom perspective view of a knob sliding mounting panel 22*a*. FIGS. 5 and 6 show bottom and side perspective views of a handle sliding mounting panel 22*b*. FIGS. 7-10 show preferred alternative cross-sectional views of a sliding mounting panel 22. FIG. 7 shows an embodiment in which the cross-section of the sliding protrusion component 26*b* is shaped like a triangle with a missing top (an isosceles trapezoid). FIG. 8 shows an embodiment in which the cross-section of the sliding protrusion component 26*b* is shaped like a lollipop (a stick with a ball, ellipse, or oval thereon). FIG. 9 shows an embodiment in which the cross-section of the sliding protrusion component 26*b* is shaped like a "T" (a stick with another stick perpendicular thereto). FIG. 10 shows an embodiment in which the cross-section of the sliding protrusion component 26*b* is shaped like a "V" (where the point of the "V" is distal from the mounting component 26*a*). What is consistent between these alternative embodiments is that the sliding protrusion component 26*b* is narrower where it is adjacent to the mounting component 26*a* and wider where it is distal from the mounting component 26*a*. The distal portion of the sliding protrusion component 26*b*, therefore, functions both as a guiding mechanism to help keep the sliding protrusion component 26*b* in sliding engagement with the base(s) 24 (sliding relationship) and as a retention mechanism to help keep the sliding protrusion component 26*b* retained within with the base(s) 24 (retaining relationship).

In preferred embodiments of the present invention, the sliding protrusion component 26*b* has at least one bore stop 42. The bore stop 42 provides an inlet into which the tip of the fastener 40 rests when the pull mechanism 20 has been properly installed. With the tip of the fastener 40 in place in the bore stop 42, the sliding protrusion component 26*b* (and therefore the sliding mounting panel 22) can no longer slide in relation to the base(s) 24.

It should be noted that the shapes and sizes of the shown exemplary mounting components 26*a* are meant to be exemplary and are not meant to limit the scope of the invention. Exemplary alternative shapes may include any geometrical shape (e.g. circular, square, rectangle, and oval), any realistic shape (e.g. flower-shaped, boat-shaped, and animal-shaped), and any abstract shape (e.g. waves, and squiggles). The size may also be varied based, for example, on intended use, location, and user.

Figure 11:
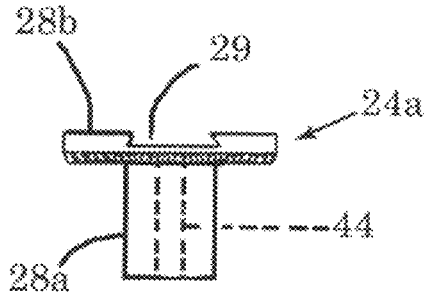
FIG. 11 is a side perspective view of a knob base or a latitudinal side view of a handle base.
Figure 12:
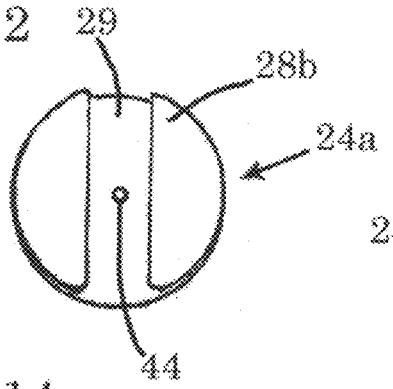
FIG. 12 is a top perspective view of a knob base.
Figure 13:
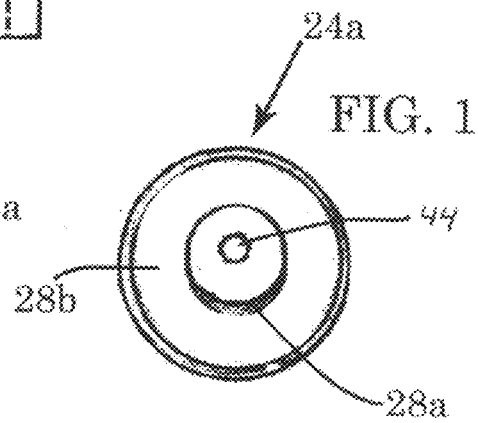
FIG. 13 is a bottom perspective view of a knob base.
Figure 14:
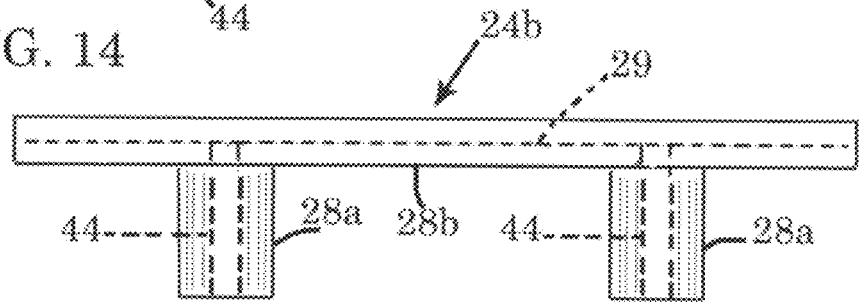
FIG. 14 is a longitudinal side view of a handle base.
Figure 15:
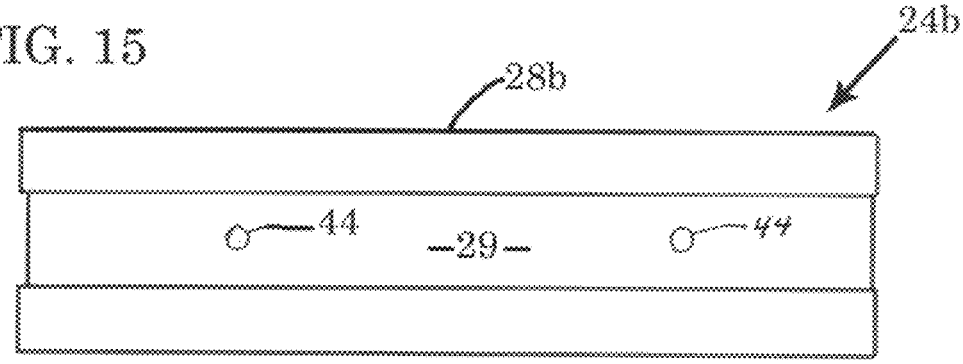
FIG. 15 is a top view of a handle base.

Each base 24 is constructed of two components, a support component 28*a* and a sliding undercut groove component 28*b* (with an undercut groove 29 therein). The undercut groove 29 can be thought of as the second sliding-retaining member. It should be noted that the components may be separate (multiple pieces attached together or held together by fastener 40 through the bore passage 44) and/or integral. FIGS. 11-13 show side, top, and bottom perspective views of a knob base 24*a*. FIGS. 14 and 15 show longitudinal side and top views of a handle base 24*b*. The latitudinal side view of the handle base 24*b* could be substantially identical to the side view of the knob base 24*a* shown in FIG. 11.

The support components 28*a* are used to distance the sliding undercut groove component 28*b* and removable sliding mounting panel 22 from the barrier structure 50. It should be noted that the shapes and sizes of the shown exemplary support components 28*a* are meant to be exemplary and are not meant to limit the scope of the invention. Exemplary alternative shapes may include any three-dimensional geometrical shape (e.g. cylindrical, cubical, a rectangular prism, and conical), any realistic shape (e.g. flower-shaped, boat-shaped, and animal-shaped), and any abstract shape (e.g. waves, and squiggles). The size may also be varied based, for example, on intended use, location, and user.

The sliding undercut groove component 28*b* has an undercut groove 29 (a groove cut below the surface leaving at least one overhang—this is not just a straight groove cut perpendicular to the surface). The undercut groove 29 is designed to mate with a respective sliding protrusion component 26*b*. It should be noted that the sliding undercut groove component 28*b* and the undercut groove 29 therein of FIGS. 11-15 are designed to mate with the sliding protrusion component 26*b* of FIG. 7, but alternative sliding undercut groove components 28*b* (and undercut grooves 29 thereof) would mate with the alternative sliding protrusion components 26*b* shown in FIGS. 8-10. In all the shown embodiments the sliding undercut groove component 28*b* has a narrow longitudinal opening such that the sliding protrusion components 26*b* is able to slide longitudinally therein (sliding relationship), but it cannot escape therefrom if pulled up/outwardly (retaining relationship). In other words, the sliding protrusion component 26*b* is in sliding relationship with the undercut groove component 28*b* such that longitudinal movement (parallel to the sliding protrusion component and undercut groove) is permitted, but the sliding protrusion component 26*b* is retained within the undercut groove 29 such that forces perpendicular to the axis of longitudinal movement cannot separate the sliding mounting panel 22 from the base 24 (i.e. the sliding mounting panel 22 from the base 24 cannot be pulled apart perpendicularly).

It should be noted that the support component(s) 28*a* may be separate from the sliding undercut groove component 28*b*, attached (e.g. by adhesive, welding, or other permanent or semi-permanent means) to the sliding undercut groove component 28*b*, and/or integral with the sliding undercut groove component 28*b*.

For the embodiments shown in FIGS. 14 and 15, two support components 28*a* are positioned on the bottom surface of the sliding undercut groove component 28*b*. In this shown embodiment, the support components 28*a* are placed 3.0" (7.62 cm) apart so as to easily replace or adapt to barrier structures 50 that require a 3.0" (7.62 cm) spacing.

The sliding undercut groove components 28*b*, like the mounting components 26*a* and support components 28*a*, may be constructed in a variety of shapes and sizes. The sliding undercut groove components 28*b* of knob bases 24*a* do not have to be circular and the sliding undercut groove components 28*b* of handle bases 24*b* do not have to be rectangular. For example, FIG. 16 shows a side view of an alternative preferred embodiment of a knob base 24*a* that has an elongated rectangular sliding undercut groove component 28*b*. This embodiment would still be considered a knob bases 24*a* because it only has a single support component 28*a* (point of contact) that attaches to the barrier structure 50 even though it has an elongated sliding undercut groove component 28*b*.

FIG. 17 is a top view of another alternative preferred embodiment of a sliding undercut groove component 28*b* in that it has multiple bore, passages 44 through which a fastener 40 may be inserted. One or more support components 28*a* could be positioned to straddle one or more bore passage 44 openings. For example a single support component 28*a* can be positioned just below a central bore passage 44 or two support components 28*a* can be positioned so that there is one support component 28 below each of the outermost bore passages 44. This is another example of how the present invention allows the user flexibility in design. It also allows the present invention to be used with barrier structures 50 with preexisting bores 52 therethrough, even if the preexisting bores are non-standard.

FIG. 18 is a perspective side view of another preferred embodiment of a knob base 24*a*. In this embodiment the support component 28*a* and the sliding undercut groove component 28*b* have substantially identical circumferences. In yet another embodiment, the support component 28*a* and the sliding undercut groove component 28*b* could be a single integral unit.

In addition to variations in shape and size, preferred embodiments of the removable sliding mounting panels 22 and bases 24 may be made from a variety of materials, may be made in a variety of different colors, and/or may have different features so that the components (e.g. the sliding mounting panels 22 and the bases 24) may be "mix and matched" for customizability. In preferred embodiments, the top surface of the sliding mounting panel 22 is preferably a non-porous surface to which decorative elements 30 may be adhered.

As set forth above, the sliding mounting panels 22 and bases 24 are in sliding-retaining relationship to each other. The sliding component of this relationship is shown, for example, in FIGS. 1-3 in that longitudinal movement is permitted parallel to the sliding protrusion component and undercut groove. In preferred embodiments such as those shown in FIGS. 19-21, there is a closed position in which the mounting panel 22 is in alignment with the base(s) 24 so that the bore passage(s) 44 is/are aligned with the bore stop(s) 42. As will be discussed, a fastener 40 is inserted though the bore passage 44 in the base 24 and the tip of the fastener is embedded in the bore stop 42 of the sliding protrusion component 26*b* of the sliding mounting panel 22.

When secured to a barrier structure 50 using a fastener 40, however, in preferred embodiments of the present invention, a fastener 40 may be used both to secure the base 24 to a barrier structure 50 and to secure the sliding mounting panel 22 to the base(s) 24.

It should be noted that FIG. 21 shows an alternative preferred embodiment of a pull mechanism 60 (either a side view of an alternative knob pull mechanism in its closed position or a latitudinal side view of an alternative handle pull mechanism in its closed position). This alternative embodiment has a sliding mounting panel 62 and a base 66. This alternative sliding mounting panel 62 has a mounting component 64*a* and undercut groove component 64*b*, the undercut groove component 64*b* having an undercut groove 65 therein. This alternative base 66 has a support component 68*a* and a sliding protrusion component 68*b*. In this embodiment, the undercut groove 65 can be thought of as the first sliding-retaining member and the sliding protrusion component 68*b* can be thought of as the second sliding-retaining member. As with the previous embodiments, the sliding protrusion component 68*b* is in sliding relationship with the undercut groove 65 such that longitudinal movement (parallel to the sliding protrusion component and undercut groove) is permitted, but the sliding protrusion component 68*b* is retained within the undercut groove 65 such that forces perpendicular to the axis of longitudinal movement cannot separate the sliding mounting panel 62 from the base 66 (i.e. the sliding mounting panel 62 from the base 66 cannot be pulled apart perpendicularly). In this embodiment, a fastener 40 may be inserted though the bore passage 44 in the base 66 (including both the support component 68*a* and the sliding protrusion component 68*b*), and the tip of the fastener 44 may be embedded in the bore stop 42 of the mounting component 64*a* of the sliding mounting panel 62.

It should be noted that the alternative embodiment of FIG. 21 (with the sliding mounting panel 62 having the undercut groove 65 and the base 66 having the sliding protrusion component 68*b*) can be implemented in the manner discussed for other embodiments. For example, there could be knob embodiments or handle embodiments. Another example is that the sliding protrusion component 68 can have a cross-section similar to those shown in FIGS. 7-10. Yet another example is that decorative elements 30 may be adhered to the sliding mounting panel 62.

It should be noted that other alternative embodiments are possible. For example, one embodiment that is not shown has a pocket-like sliding mounting panel in sliding-retaining relationship with a base. In this embodiment the fastener that fastens a pull mechanism to a barrier structure does not have to limit the sliding relationship between the sliding mounting panels and the base(s) because the bottom of the pocket-like sliding mounting panel limits the movement.

Decorative Elements

In addition to the customization discussed above (e.g. the mixing and matching of components (e.g. the sliding mounting panels 22 and the bases 24)), preferred embodiments of the present invention allow the user to customize the style of each pull mechanism 20 by attaching decorative elements 30 to the top surface (remote from the sliding protrusion component 26*b*) of the mounting component 26*a* of the removable sliding mounting panel 22. The "attaching" may be accomplished using, for example, adhesive (shown, for example, in FIG. 20 holding decorative elements 30 to the top surface of the mounting panel 22) and/or other attachment mechanisms (e.g. screws, wires, hooks, hook and loop fabric). Alternative embodiments of the mounting panels may be, for example, hollow such that the "attachment" is accomplished by filling the mounting panel (e.g. a hollow mounting component 26*a*). Alternative embodiments of the mounting panels may be made of or have a layer of attachment material, for example, cork, sheet adhesive, or foam to which objects may be attached. The customization may be based, for example, on a theme, a need, or a design.

The following list of exemplary decorative elements 30 is not to be taken as all-inclusive, as elements can be combined, or elements that are not commonly known, may also be attached to the mounting component 26*a*: glass, bamboo, iron, leather, shells, game pieces, automotive items, buttons, children's art, tile, rocks, beads, wood, polymer clay, holiday décor, mechanical items, blocks, photos, ceramics, steel, children's toys (e.g. LEGOS®), jewels/gems, textiles, tools, electrical items, baubles, learning aids, natural elements, mirrors, structural elements, seasonal items, labels, artistic elements, and store bought items.

Preferably, a user first plans and designs his pull mechanism(s) 20. The design (particularly three-dimensional decorative elements 30) should be tested prior to adhering the decorative elements 30 in order to assure proper size, proportion, placement, and ease of use. Testing can be accomplished using a temporary adhesive (e.g. tape) to temporarily attach the decorative elements 30 to the top surface of the sliding mounting panel 22 and holding or temporarily mounting it to the barrier structure 50.

In one exemplary embodiment, after the user is completely satisfied with the appearance of his pull mechanism(s) 20, he will begin the process of applying adhesive. In some preferred embodiments the adhesive is a two-part adhesive that is mixed together using a wooden stick for which instructions are provided. After the adhesive is completely mixed together, the stick is used to place a generous amount onto the top surface of the sliding mounting panel 22 and the decorative elements 30 are applied as per previous retrofit. Before the pull mechanism(s) 20 is/are attached to the barrier structure 50, the adhesive should be left to dry to assure proper adhesion.

Attachment to Barrier Structure(s)

Figure 24:
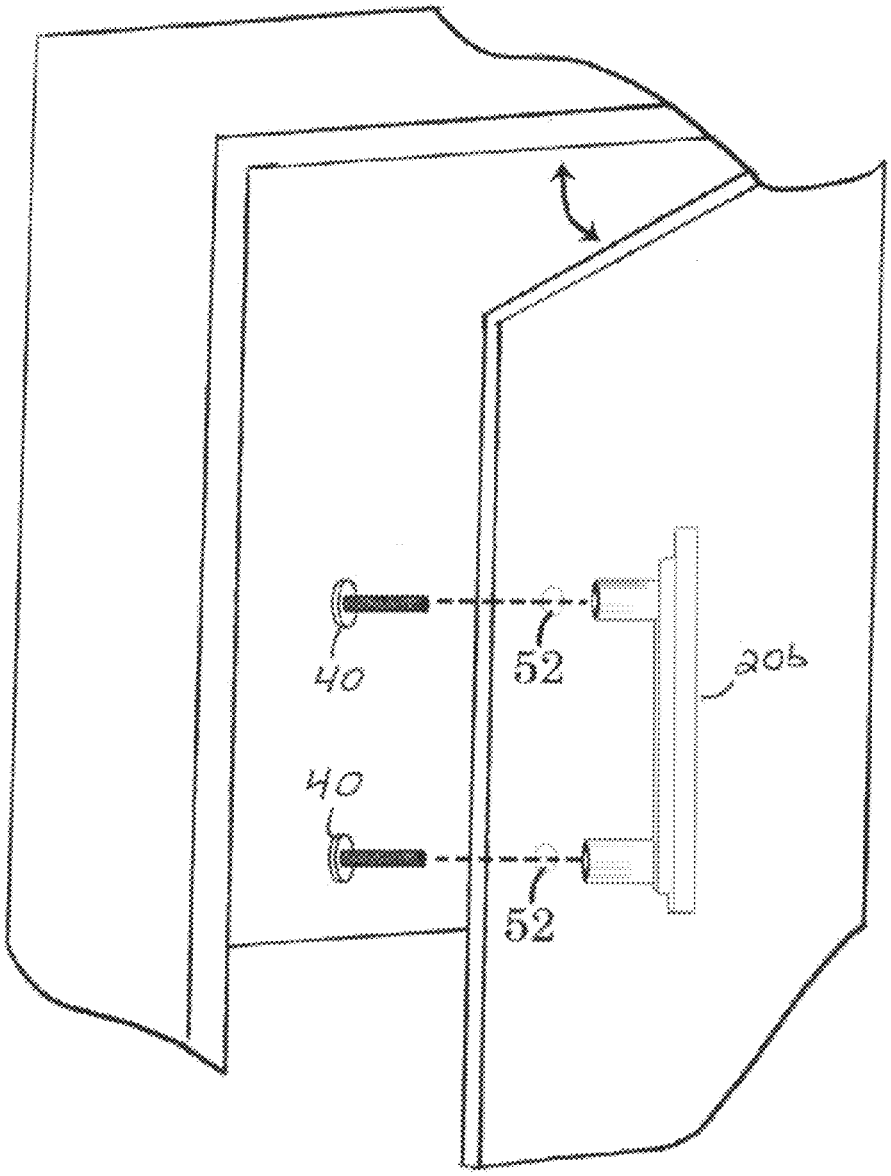
FIG. 24 is an expanded perspective view of a handle being fastened to a swinging barrier structure.

Once the pull mechanisms 20 have been configured in their closed position (the mounting panel 22 being in alignment with the base(s) 24 so that the bore passage(s) 44 is/are aligned with the bore stop(s) 42), they can be attached to barrier structures 50. As shown in FIGS. 22-24, a fastener 40 is used to fasten the pull mechanism 20 to the barrier structure 50 by inserting the fastener 40 through a bore 52 in the barrier structure 50, through a bore passage 44 in the base 24, and into a bore stop 42 of the sliding mounting panel 22. In preferred embodiments, this same fastener 40 also limits the sliding relationship between the sliding mounting panels 22 and the base(s) 24.

The fastener 40 may be, for example, a standard a screw or a bolt. If the thickness of the barrier structure 50 is unknown, multiple fasteners 40 may be provided to the user. Alternatively, the fastener 40 may be cut to the appropriate size by the user. Another alternative embodiment uses washers (not shown) to adjust for barrier structures 50 that are too thin for a long fastener 40. In still other alternative embodiments, the fastener 40 may be a metal threaded dowel or stud with a nut on one end (e.g. an adjustive bolt) so that the user may insert the metal threaded dowel or stud fastener like a screw fastener, but then use the nut to tighten the fastener. This type of adjustable fastener or other types of adjustable fasteners would accommodate barrier structures of many different thicknesses. Finally, in certain situations, the barrier structure 50 may be very thick or may not be accessible. In such a case an anchor bolt could be used by inserting the anchor bolt into the barrier structure 50 and then twisting the pull mechanism 20 so that the free end of the anchor bolt threads through the bore passage 44 in the base 24 and into a bore stop 42 of the sliding mounting panel 22.

One unique feature of the present invention is that users may interchange mounting panels 22. Multiple mounting panels 22 may be customized and switched at will. To switch between a first mounting panel 22 and a second mounting panel 22, the user would loosen (unscrew) the fastener 40 until it backs out of the bore stop 42 of the sliding mounting panel 22. The first mounting panel 22 can then be slid longitudinally out of the undercut groove 29 of the base 24. The second mounting panel 22 can then be slid longitudinally into the undercut groove 29 of the base 24. Finally, the user would tighten (screw) the fastener 40 until it has positioned within the bore stop 42 of the second mounting panel 22, and thus secure the second mounting panel 22 so that it can no longer slide longitudinally in relation to the base 24.

Preferred embodiments of the present invention further provide for mounting objects to barrier structures 50. Without the present invention, mounting adhesives or hardware generally require that the mounted object is flush against a barrier structure 50 to which it will be mounted. Preferred embodiments of the present invention can be used to mount an object or objects at a distance from (away from) the barrier structure 50. This provides the ability to mount an object that has varying thicknesses or is irregular in shape. This also provides a space between the object and the barrier structure 50. This also provides the ability to mount an object so as to give the illusion that the object is floating above the barrier structure 50.

Although most of the pull mechanisms 20 discussed herein have been configured in their closed position (the mounting panel 22 being in alignment with the base(s) 24 so that the bore passage(s) 44 is/are aligned with the bore stop(s) 42), they can be attached to barrier structures 50. As shown in FIGS. 22-24, a fastener 40 is used to fasten the pull mechanism 20 to the barrier structure 50 by inserting the fastener 40 through a bore 52 in the barrier structure 50, through a bore passage 44 in the base 24, and into a bore stop 42 of the sliding mounting panel 22.

Advantages Over Prior Art

As discussed above, preferred embodiments of pull mechanisms of the present invention include sliding mounting panels and bases that are in sliding-retaining relationship to each other. The sliding relationship is limited (sliding between the sliding mounting panels and bases is prevented) when a fastener is used to fasten a pull mechanism to a barrier structure by inserting the fastener through a bore in the barrier structure, through a bore passage in the base, and into a bore stop in the sliding mounting panel.

Prior art such as U.S. Pat. No. 7,111,365 to Howie, Jr., U.S. Pat. No. 6,463,630 to Howie, Jr., and U.S. Pat. No. 6,842,946 to Hayden are significantly different from the present invention. The following paragraphs detail some of the differences between the prior art and the present invention as well as some of the advantages of the present inventions.

Prior art references that have replaceable caps and covers are relatively complicated devices that require multiple components, some of which appear to require complicated molding techniques to be produced. Magnets are required as one of the components in at least one prior art device.

At least some of the prior art caps and covers are designed to be pulled off. "Pulled" is significant. Knobs and handles are designed to be pulled, so for these embodiments, the motion to use the pull mechanisms is the same as the motion used to remove the caps and covers. It is possible, therefore, for a user to accidentally remove the caps and covers when they are actually intending to use the pull mechanism (e.g. to open a cabinet door or drawer).

The prior art references are not designed to support decorative elements 30. If the caps and covers are designed to tightly fit so that they can't be accidentally pulled off, the tight fit of the caps and covers would require a user to use tools (or at least his finger nails) to remove the caps and covers. The possibility of damaging the decorative elements 30 becomes very high with such a removal.

None of the references teach a sliding mounting panel in sliding-retaining relationship with at least one base base.

None of the references teach using the same fastener that fastens a pull mechanism to a barrier structure to also limit the sliding relationship between the sliding mounting panels and the base(s).

None of the references teach the combination of a sliding mounting panel in sliding-retaining relationship with at least one base and the use of the same fastener that fastens a pull mechanism to a barrier structure to also limit the sliding relationship between the sliding mounting panels and the base(s).

Miscellaneous

Preferred embodiments of the present invention may be marketed or sold as a kit. An exemplary embodiment of a kit for a single pull mechanism 20 might include the components of a single pull mechanism (e.g. components of a knob 20*a* such as a knob sliding mounting panel 22*a* and a knob base 24*a*, or components of a handle 20*b* such as a handle sliding mounting panel 22*b* and a handle base 24*b*), adhesive, an applicator (e.g. a wooden stick) for applying the adhesive, fasteners 40 for securing to a barrier structure 50, instructions, and printed samples and ideas. An exemplary embodiment of a kit for multiple pull mechanisms might include the components for multiple pull mechanisms, adhesive, an applicator, fasteners 40, instructions, and printed samples and ideas. It should be noted that the kits for multiple pull mechanisms 20 might be for multiple pull mechanisms that are all the same, or for multiple pull mechanisms that can be "mixed and matched" from different components. A hybrid-kit might include a single base 24 (or a pair of bases 24) and multiple sliding mounting panels 22 so that the user can customize each of the mounting panels (e.g. one for each season), and then rotate just the customized mounting panels 22 (but not the base(s) 24). An alternative mode for selling the present invention would allow a user to select individual components.

The descriptions and applications discussed herein are not to be construed as limiting the invention, but as examples and illustrations of the invention.

It should be noted that some terms used in this specification are meant to be relative. For example, the terms "top" and "bottom" are meant to be relative and, if the pull mechanism was rotated, the terms would change accordingly. Similarly, the term "front" is meant to be relative to the term "back." Although the terms "longitudinal" and "latitudinal" are also relative, for purposes of clarity, "longitudinal" has been used to mean in a direction parallel to the undercut groove, and "latitudinal" has been used to mean in a direction perpendicular to the undercut groove.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the term "includes" means "comprises" (e.g. a device that includes or comprises A and B contains A and B, but optionally may contain C or additional components other than A and B). It should be noted that, unless otherwise specified, the singular forms "a," "an," and "the" refer to one or more than one, unless the context clearly dictates otherwise.

All the references cited herein are, incorporated by reference.

The terms and expressions that have been employed in the foregoing specification are used as terms of description and not of limitation, and are not intended to exclude equivalents of the features shown and described. This application is intended to, cover any adaptations or variations of the present invention. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention which, as a matter of language, might be said to fall therebetween.

What is claimed is:

1. A pull mechanism attachable to a barrier structure, said pull mechanism comprising:

(a) a sliding mounting panel having a first sliding-retaining member, said sliding mounting panel having a bore stop defined therein;

(b) at least one base having a second sliding-retaining member, each said at least one base having a bore passage therethrough;

(c) said first sliding-retaining member cooperating with said second sliding-retaining member such that said sliding mounting panel is in sliding-retaining relationship with said at least one base and there is longitudinal movement therebetween; and (d) a fastener;

(e) wherein said fastener is both for fastening said pull mechanism to said barrier structure and for limiting the sliding relationship between said sliding mounting panel and said at least one base;

(f) wherein said fastener passes through a bore in said barrier structure, through said bore passage of said at least one base, and into said bore stop of said sliding mounting panel.

2. The pull mechanism of claim 1, said sliding mounting panel having a top surface to which decorative elements may be attached.

3. The pull mechanism of claim 1, wherein said sliding mounting panel and said at least one base cannot be separated by forces perpendicular to the axis of longitudinal movement.

4. The pull mechanism of claim 1, wherein said first sliding-retaining member is a sliding protrusion component and said second sliding-retaining member is an undercut groove component with an undercut groove defined therein.

5. The pull mechanism of claim 1, wherein said first sliding-retaining member is an undercut groove component with an undercut groove defined therein and said second sliding-retaining member is a sliding protrusion component.

6. A pull mechanism attachable to a barrier structure, said pull mechanism comprising:

(a) a sliding mounting panel having a first sliding-retaining member, said sliding mounting panel having a bore stop defined therein;

(b) at least one base having a second sliding-retaining member, each said at least one base having a bore passage therethrough;

(c) said first sliding-retaining member engaging said second sliding-retaining member such that said sliding mounting panel is in sliding-retaining relationship with said at least one base to facilitate longitudinal movement therebetween, and said sliding mounting panel and said at least one base cannot be separated by forces perpendicular to the axis of longitudinal movement; and (d) a fastener;

(e) wherein said fastener is both for fastening said pull mechanism to said barrier structure and for limiting the sliding relationship between said sliding mounting panel and said at least one base;

(f) wherein said fastener passes through a bore in said barrier structure, through said bore passage of said at least one base, and into said bore stop of said sliding mounting panel.

7. The pull mechanism of claim 6, said sliding mounting panel having a top surface to which decorative elements may be attached.

8. The pull mechanism of claim 6, wherein said first sliding-retaining member is a sliding protrusion component and said second sliding-retaining member is an undercut groove component with an undercut groove defined therein.

9. The pull mechanism of claim 6, wherein said first sliding-retaining member is an undercut groove component with an undercut groove defined therein and said second sliding-retaining member is a sliding protrusion component.

10. A pull mechanism attachable to a barrier structure, said barrier structure having a bore therethrough, said pull mechanism comprising:

(a) a sliding mounting panel having a first sliding-retaining member, said sliding mounting panel having a bore stop defined therein;

(b) at least one base having a second sliding-retaining member, each said at least one base having a bore passage therethrough;

(c) said first sliding-retaining member engaging said second sliding-retaining member such that said sliding mounting panel is in sliding-retaining relationship with said at least one base to facilitate longitudinal movement therebetween, and said sliding mounting panel and said at least one base cannot be separated by forces perpendicular to the axis of longitudinal movement, and (d) a fastener;

(e) wherein said fastener passes through said bore in said barrier structure, through said bore passage of said at least one base, and into said bore stop of said sliding mounting panel.

11. The pull mechanism of claim 10, said sliding mounting panel having a top surface to which decorative elements may be attached.

12. The pull mechanism of claim 10, wherein said first sliding-retaining member is a sliding protrusion component and said second sliding-retaining member is an undercut groove component with an undercut groove defined therein.

13. The pull mechanism of claim 10, wherein said first sliding-retaining member is an undercut groove component with an undercut groove defined therein and said second sliding-retaining member is a sliding protrusion component.

14. A pull mechanism attachable to a barrier structure, said pull mechanism comprising:

(a) a sliding mounting panel having a first sliding-retaining member, said sliding mounting panel having a bore stop defined therein;

(b) at least one base having a second sliding-retaining member, each said at least one base having a bore passage therethrough;

said first sliding-retaining member cooperating with said second sliding-retaining member such that (c) said sliding mounting panel is in sliding-retaining relationship with said at least one base and there is longitudinal movement therebetween; and (d) a fastener;

(e) wherein said fastener is both for fastening said pull mechanism to said barrier structure and for limiting the sliding relationship between said sliding mounting panel and said at least one base;

(f) wherein said first sliding-retaining member is an undercut groove component with an undercut groove defined therein and said second sliding-retaining member is a sliding protrusion component;

(g) wherein said fastener passes through a bore in said barrier structure, through said bore passage of said at least one base, and into said bore stop of said sliding mounting panel.

15. The pull mechanism of claim 14, said sliding mounting panel having a top surface to which decorative elements may be attached.

16. The pull mechanism of claim 14, wherein said sliding mounting panel and said at least one base cannot be separated by forces perpendicular to the axis of longitudinal movement.

* * * * *